United States Patent [19]

Pearl

[11] 4,204,448

[45] May 27, 1980

[54] FLUID JET CUTTING APPARATUS HAVING SELF-HEALING BED

[75] Inventor: David R. Pearl, West Hartford, Conn.

[73] Assignee: Gerber Garment Technology, Inc., South Windsor, Conn.

[21] Appl. No.: 960,116

[22] Filed: Nov. 13, 1978

[51] Int. Cl.[2] ..... B26F 3/00; D06H 7/00

[52] U.S. Cl. ..... 83/177; 83/170; 83/658; 83/925 CC

[58] Field of Search ..... 83/15, 53, 171, 177, 83/658, 170, 925 CC; 269/289 R

[56] References Cited

U.S. PATENT DOCUMENTS

| | | | |
|---|---|---|---|
| 3,677,123 | 7/1972 | Gerber et al. | 83/925 CC X |
| 3,927,591 | 12/1975 | Gerber | 83/177 |
| 3,978,748 | 9/1976 | Leslie et al. | 83/177 X |
| 4,112,797 | 9/1978 | Pearl | 83/925 CC X |

*Primary Examiner*—Frank T. Yost

*Attorney, Agent, or Firm*—McCormick, Paulding & Huber

[57] ABSTRACT

A fluid jet cutting apparatus has a material supporting bed comprising a tank-like structure and containing a substance maintained in at least a partially frozen condition by refrigerant coils. The solidified surface of the substance provides a supporting surface for material to be cut and is reconstituted after a jet of cutting fluid passes therethrough.

14 Claims, 5 Drawing Figures

FLUID JET CUTTING APPARATUS HAVING SELF-HEALING BED

BACKGROUND OF THE INVENTION

This invention relates in general to apparatus for cutting sheet material and deals more particularly with improved high velocity fluid jet cutting apparatus for automated production cutting of limp sheet materials such as fabrics, plastic, paper, leather, rubber and the like. In an apparatus of the aforedescribed general type, a high pressure fluid jet, focused by a nozzle, functions as an omnidirectional cutting "blade" which produces a narrow kerf. Such apparatus is particularly suitable for cutting intricate shapes from multi-ply materials. The high pressure fluid jet stream travels at supersonic speed as it is ejected from the nozzle of the cutting tool and necessarily has considerable residual energy after passing through the material which has been cut. This residual energy poses a potential source of damage to the cutting apparatus and particularly to the means for supporting a material being cut. Heretofore, apparatus of the aforedescribed general type has been provided wherein the material supporting bed comprises a laminate of severable and self-healing materials that can be penetrated by the high velocity cutting jet. The self-healing material which may, for example, be a tar, putty, or fusible plastic material which flows together after the jet has passed through it is sandwiched between layers of the severable material. Apparatus of the aforedescribed general type is illustrated and described in U.S. Pat. No. 3,927,591 to Gerber, issued July 15, 1974 and assigned to the assignee of the present invention. The present invention is concerned with improvements in apparatus of the aforedescribed general type which includes a material supporting bed of self-healing material.

SUMMARY OF THE INVENTION

In accordance with the present invention, apparatus for cutting sheet material comprises a material supporting bed which includes a tank having an open top and containing a substance which has a liquid state and a solid state. The exposed upper surface of the substance in its solid state constitutes a material supporting surface. A means within said tank maintains in a solid state at least a portion of the substance which defines the upper surface. A fluid jet cutting tool is supported above the upper surface and has a nozzle for discharging a jet of cutting fluid toward the upper surface. The apparatus also includes a means for moving the cutting tool relative to the upper surface.

DETAILED DESCRIPTION OF PREFERRED EMBODIMENTS

Figure 1:
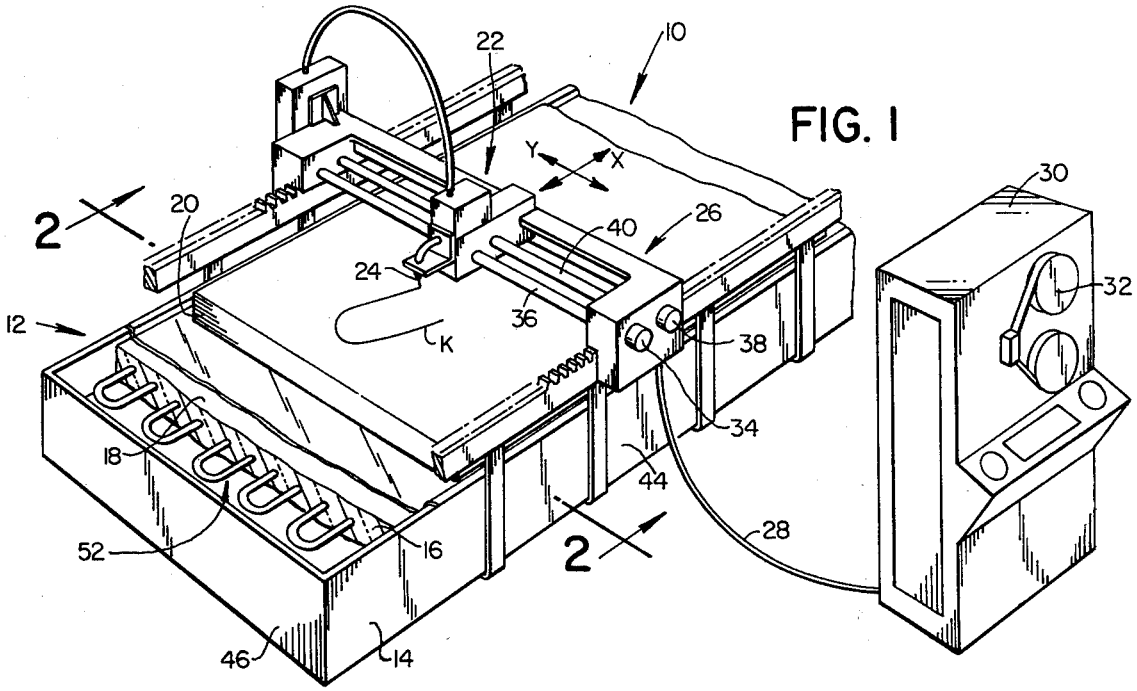
FIG. 1 is a fragmentary perspective view of a fluid jet cutting apparatus embodying the invention.

Turning now to the drawing, a fluid jet cutting apparatus embodying the present invention and illustrated in FIG. 1 is indicated generally by the reference numeral 10. The apparatus 10 is particularly adapted for automated production cutting of sheet material and includes a material supporting bed indicated generally at 12. The bed generally comprises a tank 14 which is open at its top and contains a substance 16 which has a solid state and a liquid state and an exposed upper surface 18. The tank 14 also contains means for altering the physical state of the substance 16 to maintain in a solid state at least that portion of the substance which defines its upper surface 18. A lay-up of limp sheet material indicated at 20, which may comprise a single sheet or as many as several hundred sheets of woven or non-woven fabric or like material, is shown supported in vertically stacked relation by the solid surface 18.

The material 20 is cut by a high velocity fluid jet cutting mechanism, indicated generally at 22 which has a jet nozzle 24, and which is mounted above the bed 12 on a movable carriage assembly indicated generally by the numeral 26. The carriage assembly is supported for movement relative to the supporting bed 12 to move the nozzle 24 in longitudinal and transverse coordinate directions, as indicated by X and Y coordinate axes shown in FIG. 1. The carriage assembly moves in response to control signals received through a cable 28 from a programmable computer 30. The illustrated computer 30 reads digital data from a program tape 32 which defines contours of a cutting path. A high velocity fluid cutting jet emitted from the nozzle 24 impinges upon the lay-up 20, forms a kerf K therein, and moves in cutting engagement with the lay-up to cut patterns from it in response to the control signals transmitted by the computer 30. More specifically, the computer 30 transmits control signals to a drive motor 34 which drives a lead screw 36 to move the carriage assembly and the jet nozzle 24 longitudinally of the supporting bed 12 in one or the opposite X-coordinate direction. The computer 30 also transmits control signals to another drive motor 38 which drives a lead screw 40 to move the jet nozzle 24 relative to the carriage assembly 26 and transversely of the supporting bed 12 in one or the opposite Y-coordinate direction.

Figure 2:
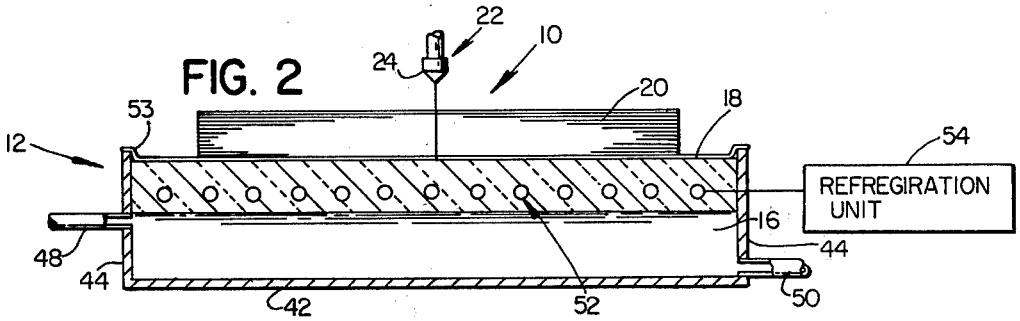
FIG. 2 is a somewhat enlarged fragmentary sectional view taken along the line 2—2 of FIG. 1.

The tank 14 is generally rectangular and has a bottom wall 42, side walls 44, 44, and opposite end walls 46, 46, only one of which is shown in FIG. 1. Fluid inlet and outlet conduits indicated by the numerals 48 and 50, respectively, communicate with the interior of the tank 14, as shown in FIG. 2. Refrigerant coils indicated generally at 52 in FIG. 2 are located within the upper portion of the tank 14 below its upper edge and are connected to an exterior refrigeration unit 54. The substance 16, which may, for example, be water, is maintained at a level above the refrigerant coils 52.

A conventional hydraulically pressurized fluid jet cutting mechanism 22 is used to deliver a steady stream of cutting fluid under pressure to the jet nozzle 24. The mechanism 22 preferably includes an intensifier pump for delivering fluid under pressure to the nozzle and a pressure smoothing accumulator which smooths pressure pulsations from the pump so that fluid is supplied to the nozzle at substantially constant pressure, which may, for example, be in a range of from 10,000 psi to 100,000 psi. A typical nozzle may, for example, have a throat aperture in the range of 0.004 inches to 0.016 inches which produces an extremely fine high velocity fluid jet stream at the nozzle capable of penetrating and cutting through a multi-ply lay-up of cloth, plastic, leather or other material to be cut. Various cutting fluids may be used, however, it is preferable that the substance 16 also be used as a cutting fluid. Thus, when the substance 16 in the tank 14 is water it is preferable that water also be used as a cutting fluid.

Preparatory to cutting a lay-up of sheet material, the refrigeration unit 54 is operated to freeze the water 16 at least near its surface 18 whereby to form an ice bed for supporting the lay-up. This ice bed will support the material during lay-up or, if desired, a previously laid-up stack of material can be slid onto the ice surface. A layer of paper or plastic 53, such as polyethylene film, may be positioned between the lay-up and the ice surface 18. The jet nozzle 24 is positioned above the stationary lay-up 20 by the movable carriages 26 which moves in response to a selected taped program. The fluid jet emitted from the nozzle cuts through the lay-up and into or through the ice layer and may be absorbed in the water below the ice layer without backsplash. The thin kerf formed in the ice (less than 0.010 inch wide) supports the lay-up closely during tangent cuts and will quickly refreeze as the cutting jet moves on. Thus, the supporting bed 10 is entirely self-healing and normally requires no substantial maintenance other than that which may be required to maintain a constant level of water in the tank 14. The inlet and outlet conduits 48 and 50, respectively, facilitate maintenance of a constant liquid level within the tank 14.

Figure 3:
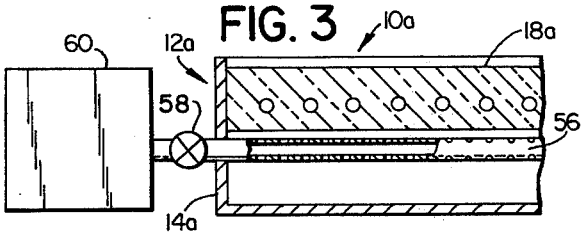
FIG. 3 is similar to FIG. 2 but shows another apparatus embodying the invention.

Another fluid jet cutting apparatus embodying the present invention and indicated generally by the reference numeral **10*a* in FIG. 3 utilizes a supporting bed of "spongy ice" to support a lay-up of sheet material. Such spongy ice may be formed by agitating water during freezing or by the use of chemical additives in the water. The apparatus 10*a* shown in FIG. 3 is similar to the apparatus 10, previously described, however, it includes an air manifold 56 located within the tank and below the surface 18*a*. The manifold 56 is connected through a valve 58 to an external source of air under pressure, indicated at 60** and introduces air under pressure into the water to agitate the water during the refrigeration cycle.

A similar result may be attained without the requirement of special agitating apparatus by filling the tank with shaved ice flakes to form a supporting bed which has a surface consistency similar to that of packed snow. The advantage of using "spongy ice" or another substance having the consistency of packed snow is that the surface of such a substance will readily absorb the volume of water discharged by a fluid jet cutting apparatus performing a normal cutting operation without apparent disturbance of the surface. Such a surface can be readily reconstituted by refreezing or by the addition of water or shaved ice. Such a surface may also be reconstituted by scraping.

Figure 4:
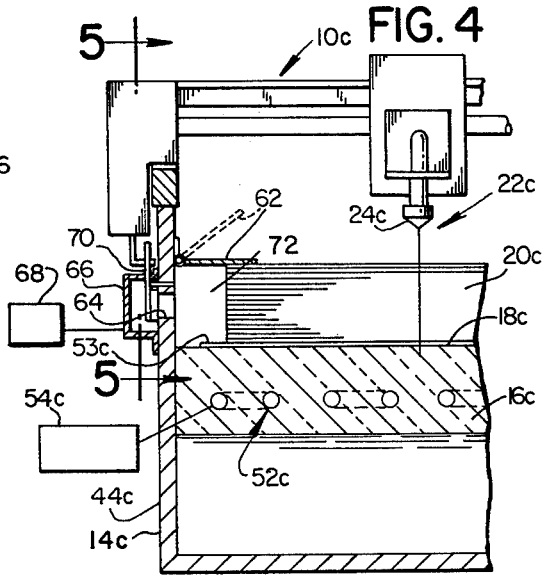
FIG. 4 is also similar to FIG. 2 but shows still another apparatus embodying the invention.
Figure 5:
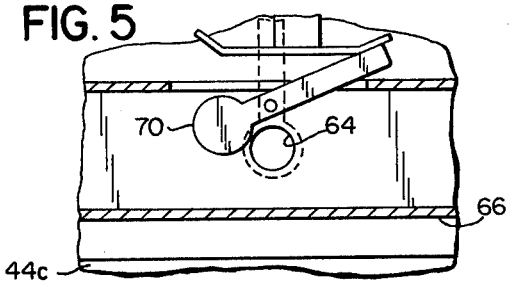
FIG. 5 is a fragmentary sectional view taken along the line 5—5 of FIG. 4.

The supporting table concept of the present invention is particularly suitable for use on a cutting table adapted to cut long, wide lay-ups, that is lay-ups which may, for example, be six feet wide by 100 feet long. Such lay-ups are preferably compacted and held during the cutting operation to assure that all layers which comprise a lay-up are uniformly and accurately cut. An apparatus for cutting such long, wide lay-ups is illustrated in FIG. 4 and indicated generally by the reference numeral **10*c*. The apparatus 10*c* is similar in many respects to the apparatus 10 previously described and includes a cutting mechanism 22*c*, which has a jet nozzle 24*c*, and a tank 14*c* which contains refrigerant tubes 52*c*. The tubes are connected to an external refrigeration unit 54*c* for freezing a substance 16*c* and maintaining at least that portion of the substance which defines its surface 18*c* in a substantially solid state. A layer of paper or plastic 53*c*, which corresponds to the layer 53 in FIG. 2, may be positioned between the surface 18*c* and the layup 20*c*, substantially as shown in FIG. 4**.

The peripheral walls of the tank **14*c* extend for some distance above the surface 18*c*, which, as shown, supports a long, wide lay-up of sheet material 20*c*. An elongated flap 62 made from relatively stiff metal or plastic is hinged along one longitudinally extending edge to each side wall 44*c* in vertically spaced relation to the surface 18*c* and extends inwardly from the side wall. A longitudinally spaced series of vacuum ports 64, 64 (one shown) are open through each side wall 44*c* between the surface 18*c* and an associated flap 62. An elongated vacuum manifold 66 connected to a suitable external vacuum source 68 is secured to each side wall 44*c* and communicates with the vacuum ports 64, 64 therein. Preferably, and as shown, each vacuum port 64 has an associated valve 70 movable between open and closed positions. In its open position each valve 70 exposes an associated valve port 64 so that the port communicates with the vacuum manifold 66. The valve 70, 70 may be arranged to operate in sequence in response to the motion of the carriage 16 in an X-coordinate direction or, if desired, each valve 70** may be provided with an individual operating motor (not shown) so that the various valves may be operated in response to a predetermined program in response to signals from an associated computer.

An inner marginal portion of each flap 62 overlies an associated upper marginal portion of the lay-up **20*c* substantially as shown in FIG. 4. When a vacuum is applied to the manifold 66, the flap 62 is drawn tightly down against the lay-up. Associated portions of the flap 62, the surface 18*c* and the inner surface of the associated side wall 44*c* cooperate with a vertical side of the lay-up 20*c* to form a vacuum chamber, indicated at 72, which communicates with the vacuum manifold 66 through the vacuum ports 64, 64 whereby vacuum is applied to the lay-up 20*c*. When valves are provided such as the valves 70, 70 vacuum may be applied locally to an area of the lay-up being cut by opening one or more valves in the immediate area laterally opposite the cut. If the lay-up comprises a porous material such as cloth, layers of plastic materials such as polyethylene film are preferably arranged in overlying and underlying relation to the lay-up to aid in the efficient compacting of the lay-up in response to applied vacuum. The application of vacuum through the vacuum chambers causes the hinged flaps 62, 62 to be drawn down against opposite marginal edges of the lay-up thereby clamping the lay-up against the surface 18*c***. The arrangement hereinbefore described provides a practical low cost construction and enables the use of a fluid jet cutting apparatus on long lay-ups such as encountered in furniture and apparel manufacturing, without the use of a large vacuum system.

I claim:

1. Fluid jet cutting apparatus comprising a material supporting bed including a tank having an open top, a substance contained in said tank and having an exposed upper surface, said subtance having a liquid state and a solid state, said upper surface in its solid state constituting a material supporting surface, and means contained within said tank for altering the physical state of said substance and maintaining in said solid state at least the portion of said substance defining said upper surface, a jet cutting tool having a nozzle for discharging a jet of cutting fluid, means supporting said cutting tool with said nozzle disposed above said upper surface to discharge said cutting fluid toward said upper surface, and means for moving said supporting means relative to said upper surface.

2. Fluid jet cutting apparatus as set forth in claim 1 wherein said substance comprises said cutting fluid.

3. Fluid jet cutting apparatus as set forth in either of claims 1 or 2 wherein said cutting fluid comprises water.

4. Fluid jet cutting apparatus as set forth in claim 1 wherein said maintaining means comprises a refrigeration apparatus including a refrigeration unit within said tank and below said upper surface.

5. Fluid jet cutting apparatus as set forth in claim 4 wherein said substance comprises a liquid and said apparatus includes means for agitating said liquid during the refrigeration cycle.

6. Fluid jet cutting apparatus as set forth in claim 5 wherein said agitating means comprises an air manifold disposed within said tank below said upper surface and means connecting said air manifold to a source of air under pressure.

7. Fluid jet cutting apparatus as set forth in claim 4 wherein said substance comprises a gelatin.

8. Fluid jet cutting apparatus as set forth in claim 4 wherein said substance comprises a viscous petroleum product which may be hardened by application of moderate refrigerating temperature.

9. Fluid jet cutting apparatus as set forth in claim 1 wherein said substance comprises shaved ice flakes having a surface consistency comparable to packed snow.

10. Fluid jet cutting apparatus as set forth in claim 1 wherein said tank comprises an elongated tank and has an elongated flap of relatively stiff material hingedly connected thereto, said flap having a longitudinally extending marginal portion for overlying an associated upper marginal portion of a layup of material to be cut supported on said bed, said flap, and associated portions of said tank and said upper surface cooperating with an associated side surface of said layup to at least partially define a vacuum chamber, and means connecting said vacuum chamber to a vacuum source.

11. Fluid jet cutting apparatus as set forth in claim 10 wherein said tank has a side wall extending for some distance above said upper surface and said flap is hingedly connected along its longitudinally extending outer edge to said side wall.

12. A fluid jet cutting apparatus as set forth in claim 11 wherein said connecting means comprises a longitudinally spaced series of vacuum ports opening through said side wall and communicating with said vacuum chamber between said flap and said upper surface and a vacuum manifold communicating with said vacuum ports.

13. A fluid jet cutting apparatus as set forth in claim 12 wherein each of said vacuum ports has a valve associated therewith and movable between open and closed positions relative thereto and means for operating said valve.

14. A fluid jet cutting apparatus as set forth in claim 13 wherein said means for operating said valve comprises means for operating each of the valves associated with said ports in sequence and in response to the movement of the supporting means relative to said bed.

* * * * *